US006789678B2

(12) United States Patent
Auclair

(10) Patent No.: US 6,789,678 B2
(45) Date of Patent: Sep. 14, 2004

(54) CARTON FOR FRAGILE ARTICLE

(76) Inventor: Jean-Michel Auclair, Mead Packaging, P.O. Box 4417, Atlanta, GA (US) 30302

( * ) Notice: Subject to any disclaimer, the term of this patent is extended or adjusted under 35 U.S.C. 154(b) by 172 days.

(21) Appl. No.: 10/143,196

(22) Filed: Jun. 26, 2002

(65) Prior Publication Data

US 2003/0024851 A1 Feb. 6, 2003

Related U.S. Application Data

(63) Continuation of application No. PCT/US00/30740, filed on Nov. 10, 2000.

(51) Int. Cl.[7] ..... B65D 81/02

(52) U.S. Cl. ..... 206/590; 206/592; 206/763; 206/277; 229/117.03

(58) Field of Search ..... 206/277, 443, 206/446, 590, 592, 779, 780, 763, 765; 229/104, 120.24, 129.1, 122, 220, 117.03, 117.01

(56) References Cited

U.S. PATENT DOCUMENTS

| | | | | |
|---|---|---|---|---|
| 1,414,236 A | | 4/1922 | Walmsley | |
| 2,617,577 A | | 11/1952 | Tardiff | |
| 2,714,981 A | | 8/1955 | Leavens | |
| 2,732,123 A | | 1/1956 | Bolding | |
| 2,764,337 A | | 9/1956 | Bolding | |
| 2,835,428 A | | 5/1958 | Herzog | |
| 3,029,998 A | | 4/1962 | Taylor, Jr. | |
| 3,115,290 A | | 12/1963 | Byassee | |
| 3,184,136 A | | 5/1965 | Forbes, Jr. | |
| 3,240,417 A | * | 3/1966 | Andreini | 206/455 |
| 3,693,866 A | | 9/1972 | Struble | |
| 4,025,039 A | | 5/1977 | Croll et al. | |
| 4,335,842 A | | 6/1982 | Bradford et al. | |
| 4,438,848 A | | 3/1984 | Montealegre et al. | |
| 5,494,166 A | | 2/1996 | Kuwata et al. | |
| 5,505,373 A | | 4/1996 | von Stillfried | |
| 5,540,330 A | | 7/1996 | Lo Duca | |
| 5,680,930 A | | 10/1997 | Stone | |
| 5,829,587 A | | 11/1998 | Saiki et al. | |
| 6,012,630 A | | 1/2000 | Block | |
| 6,092,716 A | * | 7/2000 | Smith | 229/117.04 |

FOREIGN PATENT DOCUMENTS

| | | |
|---|---|---|
| EP | 0 642 977 A1 | 3/1995 |
| EP | 0 699 588 A1 | 3/1996 |
| GB | 1 206 773 | 9/1970 |
| GB | 1 572 073 | 7/1980 |
| GB | 2 154 213 A | 9/1985 |
| GB | 2 297 538 A | 7/1996 |
| GB | 2 313 829 A | 10/1997 |
| WO | WO 99/29577 | 6/1999 |

* cited by examiner

*Primary Examiner*—David T. Fidei
(74) *Attorney, Agent, or Firm*—Tsugihiko Suzuki

(57) ABSTRACT

A carton for packaging fragile article comprising an outer sleeve and an inner article receiving structure. The inner structure comprises an inner sleeve having a first pair of opposed side walls secured to a first pair of opposed side walls of the outer sleeve and a second pair of opposed side walls spaced apart from a second pair of opposed side walls of the outer sleeve. The inner structure further comprises a first bridging closure panel hingedly connected to one end of the inner sleeve for movement between an open position where the bridging closure panel allows the inner and outer sleeves to collapse into a flat form and a closed position where the bridging closure panel forms a first brace structure between one of the second pair side walls of the inner structure and the adjacent one of the second pair side walls of the outer sleeve.

10 Claims, 12 Drawing Sheets

CARTON FOR FRAGILE ARTICLE

This is a continuation of international application No. PCT/US00/30740, filed Nov. 10, 2000, which is hereby incorporated by reference.

BACKGROUND OF THE INVENTION

The present invention relates to a carton and a carton blank for forming said carton. More particularly, the invention relates to a carton and blank for packaging fragile articles such as bottles of perfume, for example.

It is known to provide an inner support structure for fragile items. For example, U.S. Pat. No. 3,693,866 to Struble discloses a tubular carton comprising an inner and outer sections, the inner section having frangibly interconnected panels which may be separated in order to accommodate an article therebetween.

Another example is shown in U.S. Pat. No. 2,732,123 to Bolding which discloses a shock resistant tubular carton having inner and outer sections, the inner section being adapted to accommodate a vacuum type valve, and having a cut-away section provided therein.

These structures provide a degree of support but for fragile items it is desirable to support the product from above and below as well as from all sides.

A further problem with known carriers is that the inner section and outer sleeve need to be constructed and erected at the time of loading the article. This is undesirable for modern packaging machines as it limits the machine speeds. Accordingly, the present invention seeks to overcome this problem by providing a collapsible carrier.

SUMMARY OF THE INVENTION

The present invention, and its preferred embodiments, seek to overcome or at least mitigate the problems of the prior art.

One aspect of the invention provides a carton for packaging fragile articles comprising an outer sleeve and an inner article receiving structure having an aperture for receiving the article wherein the aperture straddles at least one fold line between two adjacent article receiving panels of the article receiving structure. Preferably, the article receiving panels may be folded out of mutual alignment to provide an upstanding wall and a ledge adapted to engage and retain the article. More preferably, the panels forming the upstanding wall and the ledge may be arranged in a substantially perpendicular relationship.

According to an optional feature of this aspect of the invention, the upstanding wall may be arranged so as to be substantially parallel to a longitudinal axis of the outer sleeve.

According to another optional feature of this aspect of the invention, the ledge may be arranged to be substantially perpendicular to a longitudinal axis of the outer sleeve.

According to another optional feature of this aspect of the invention, the article receiving panel forming the ledge may be secured to the outer sleeve.

According to another optional feature of this aspect of the invention, there may further comprise a platform panel struck at least in part from the upstanding wall, which platform panel is adapted to support the article. Preferably, an edge of the platform panel may abut a panel of the outer sleeve.

A second aspect provides a carton for packaging fragile articles comprising an outer sleeve and an inner article receiving structure having an upstanding wall, a ledge and an aperture for receiving the article wherein the aperture straddles at least one fold line between the upstanding wall and the ledge of the article receiving structure and wherein there further comprises a platform panel struck at least in part from the upright wall, which platform panel is adapted to support the base of the article.

According to an optional feature of the second aspect of the invention, two article receiving structures may be provided. Preferably, the article receiving structures may be disposed in mutually opposed relationship. More preferably, a panel hingedly attached to one of the article receiving structures may be folded so as to bridge the gap between article receiving structures, thereby to impart rigidity to the article receiving structures.

According to another optional feature of the second aspect of the invention, the sleeve axis of the outer sleeve and the upstanding wall of the inner article receiving structure may be parallel to each other and the fold line(s) between the upstanding wall and the ledge is generally perpendicular to the axis of the outer sleeve thereby to enable the carton to move between collapsed and erected positions.

According to a further optional feature of the second aspect of the invention, the carton may be formed from two blanks. Preferably, one blank may be provided for the outer sleeve, and one blank may be provided for the article receiving structure(s).

A third aspect of the invention provides a carton for packaging fragile articles comprising an outer sleeve including an end closure structure and an inner article receiving structure having an aperture for receiving the article wherein the article receiving structure may further comprise a beveled portion such that a securing flap of the end closure structure of the outer sleeve may be guided into a gap between the article receiving structure and the outer sleeve.

A fourth aspect of the invention provides a blank for forming a carton for packaging one or more fragile articles, the blank comprising panels for forming an outer sleeve and an inner article receiving structure comprising an upstanding wall panel and a ledge panel and an aperture for receiving the article wherein the aperture straddles at least one fold line between the upstanding wall panel and ledge panel of the article receiving structure.

Preferably, there may further comprise a platform panel struck at least in part from the upright wall, which platform panel is adapted to support the article in a set up condition. More preferably, the platform panel may extend into the aperture.

A fifth aspect of the invention provides a method of forming a carton for packaging fragile articles comprising an outer sleeve and an inner article receiving structure, which method comprises the steps of: folding and forming the article receiving structure such that article receiving panels in which an article receiving aperture is provided are folded out of mutual alignment; and folding and forming an outer sleeve so as to encircle the article receiving structure.

Optionally, the article receiving panels may comprise an upstanding wall and a ledge wherein the panel forming the ledge is folded away from the axis of the outer sleeve to form the ledge and reveal the article receiving aperture.

According to an optional feature of the firth aspect of the invention, there may further comprise the step of folding a bridging panel so as to span a gap between the article receiving structure and a second article receiving structure.

BRIEF DESCRIPTION OF THE DRAWINGS

Exemplary embodiments of the present invention will now be described, by way of example only, with reference to the accompanying drawings in which.

DETAILED DESCRIPTION OF THE PREFERRED EMBODIMENTS

Figure 1:
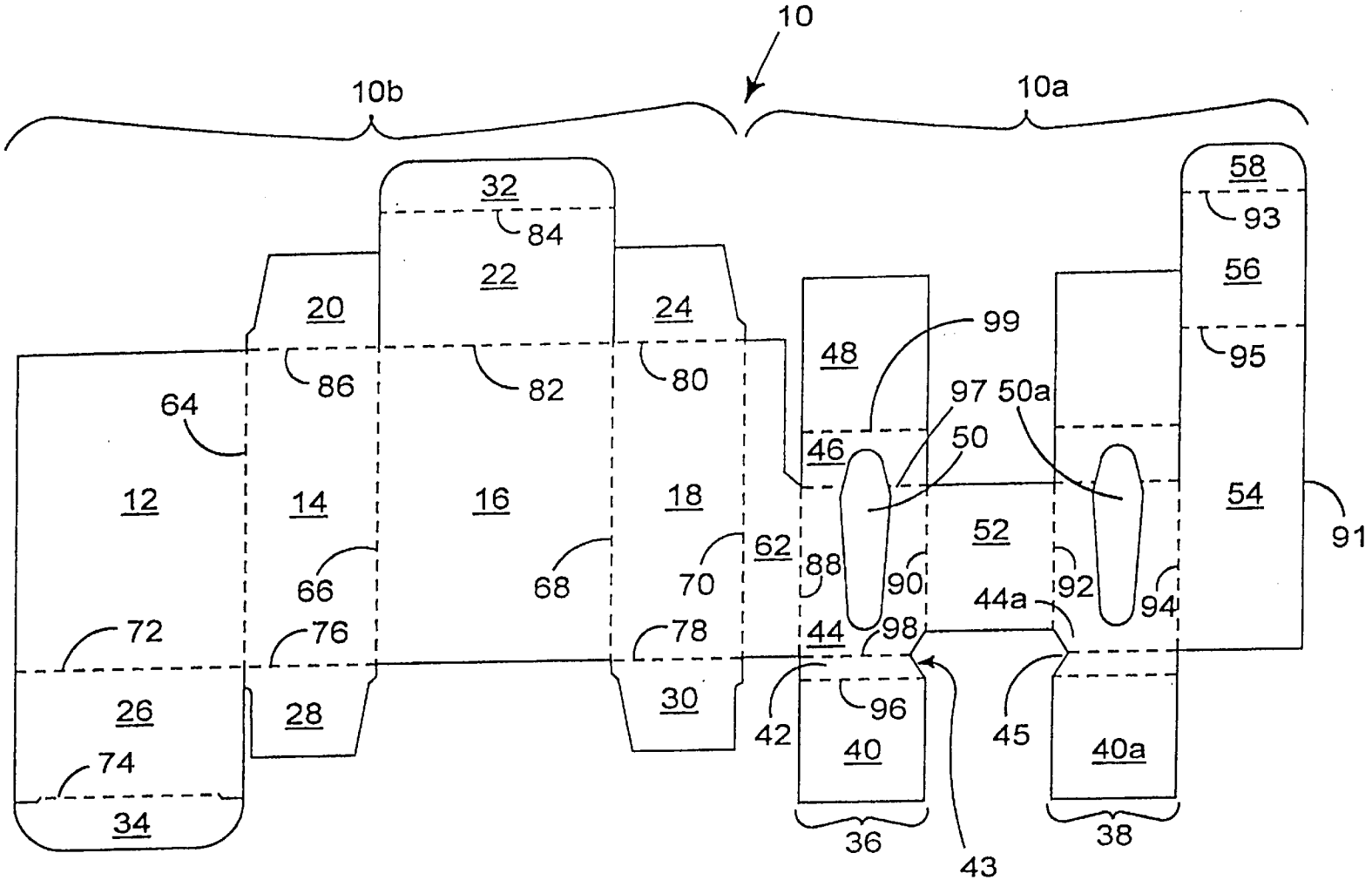
FIG. 1 is a plan view of a blank according to one embodiment of the invention.
Figure 7A:
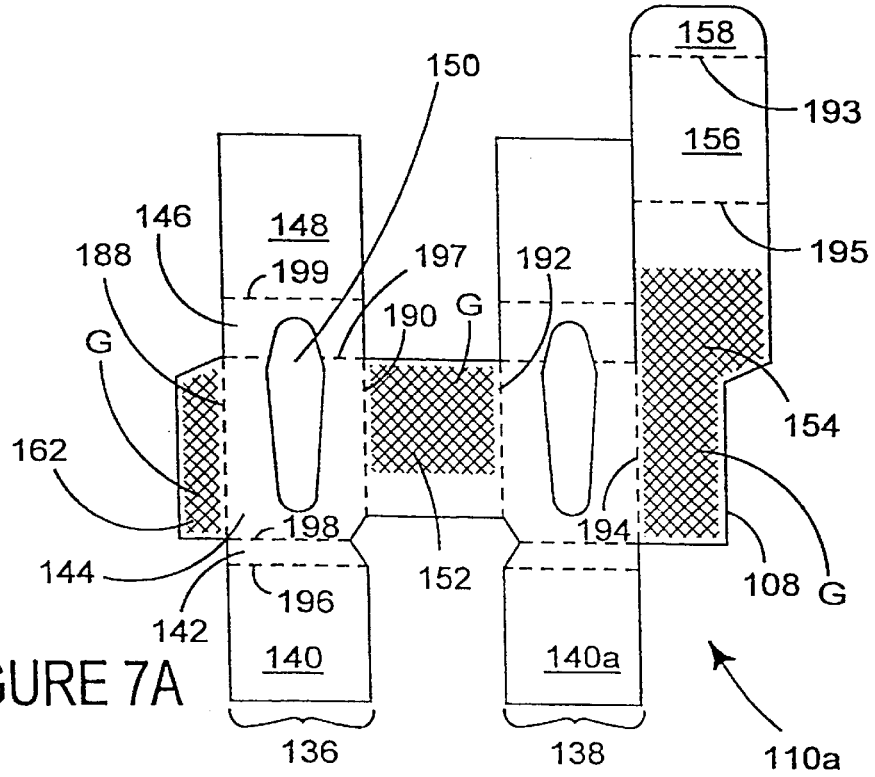
FIGS. 7A and 7B are plan views of a two part blank according to a second embodiment of the invention.
Figure 7B:
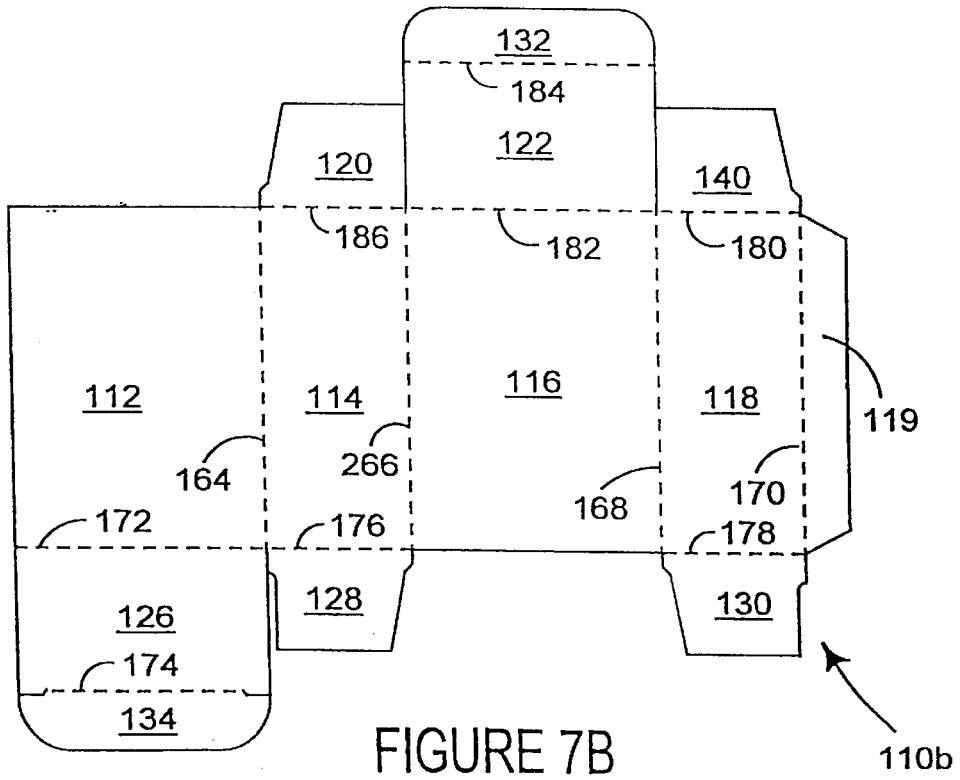

Referring to the drawings and in particular FIG. 1, a carton is formed from a single blank 10 of paperboard or similar foldable sheet material adapted to accommodate an article such as a bottle, particularly a fragile article such as a bottle of perfume, for example. Of course, it is envisaged that one or more blanks could be used, one example of which is shown in FIGS. 7A and 7B, described in more detail below.

The blank comprises two portions, outer sleeve 10*b*, and inner sleeve 10*a*. Turning first to outer sleeve 10*b*, there comprises a first side wall panel 12, first end wall panel 14, second side wall panel 16 and second end wall panel 18 are hingedly interconnected in series along fold lines 64, 66 and 68 respectively. A base wall panel 26 is provided that is preferably hingedly connected to first side wall panel 12 along fold line 72. A securing flap 34 is hingedly connected to base wall panel 20 along fold line 74. First and second base end flaps 28 and 30 complete a base wall structure and are preferably hingedly interconnected to first and second end wall panels 14 and 18 along fold lines 76 and 78 respectively.

Top wall structure preferably comprises a top wall panel 22 hingedly interconnected to second side wall panel 16 along fold line 82, and top end flaps 20 and 24 hingedly connected to first and second end wall panels along fold lines 86 and 80 respectively. A securing flap 32 is, in this embodiment, hingedly connected to top wall panel 22 along fold line 84. It should be recognised that in alternative classes of embodiment other known top and base closure structures may be employed.

Turning to inner sleeve portion 10*a*, there is provided in series first securing panel 62, first article receiving structure 36, second securing panel 52, second article receiving structure 38, and third securing panel 54, hingedly interconnected along fold lines 88, 90, 92 and 94 respectively. First securing panel 62 is further hingedly connected to second side panel 18 of the outer sleeve 10*a* along fold line 70.

Second article receiving structure 38 is, in this embodiment, essentially identical to the first article receiving structure. Therefore, only first receiving structure 36 is described in greater detail. Structure 36 preferably comprises central bridging panel 40, recessing panel 42, main receiving panel 44, transverse receiving panel 46 and end wall contacting panel 48 hingedly interconnected in series along fold lines 96, 98, 100 and 102 respectively. Advantageously, the corners of recessing panel 42 and main receiving panel 44 are beveled adjacent fold line 98 for reasons explained below.

In addition, an elongate aperture 50 is provided in main receiving panels 44 for receiving the article A, once the blank has been erected to form a carton. Preferably, the aperture 50 extends into transverse receiving panel 46. Naturally, the size and shape of the aperture may be altered to receive differing articles.

An inner cover panel 56 is preferably hingedly connected to third securing panel 54 along fold line 104. A securing flap 58 is further advantageously hingedly connected to inner cover panel 56 along fold line 106.

It is envisaged that the carton of the first, second or third embodiments of the present invention can be formed by a series of sequential folding and gluing operations in a straight line machine so that the carton is not required to be rotated or inverted to complete its construction. The folding process is not limited to that described below and may be altered according to particular manufacturing requirements.

Figure 1A:
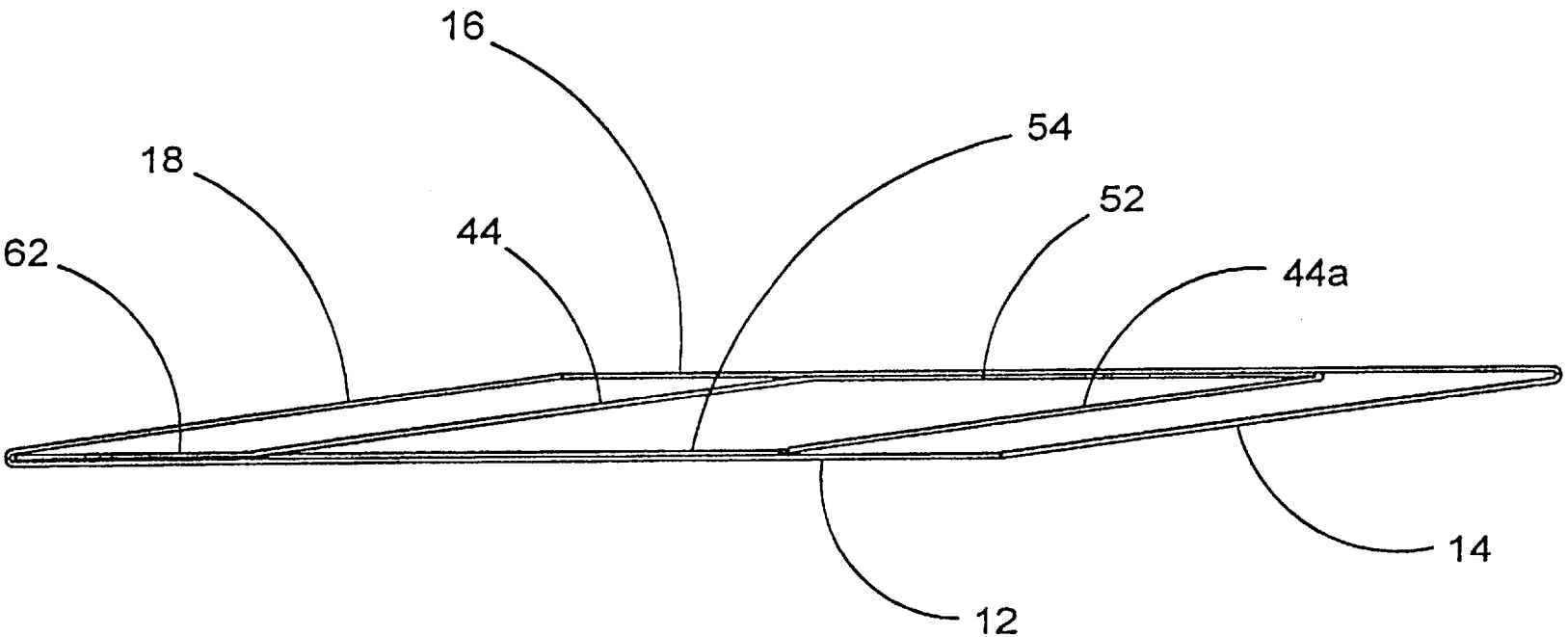
FIG. 1A illustrates the blank of FIG. 1 part-constructed in a flat collapsed condition.
Figure 2:
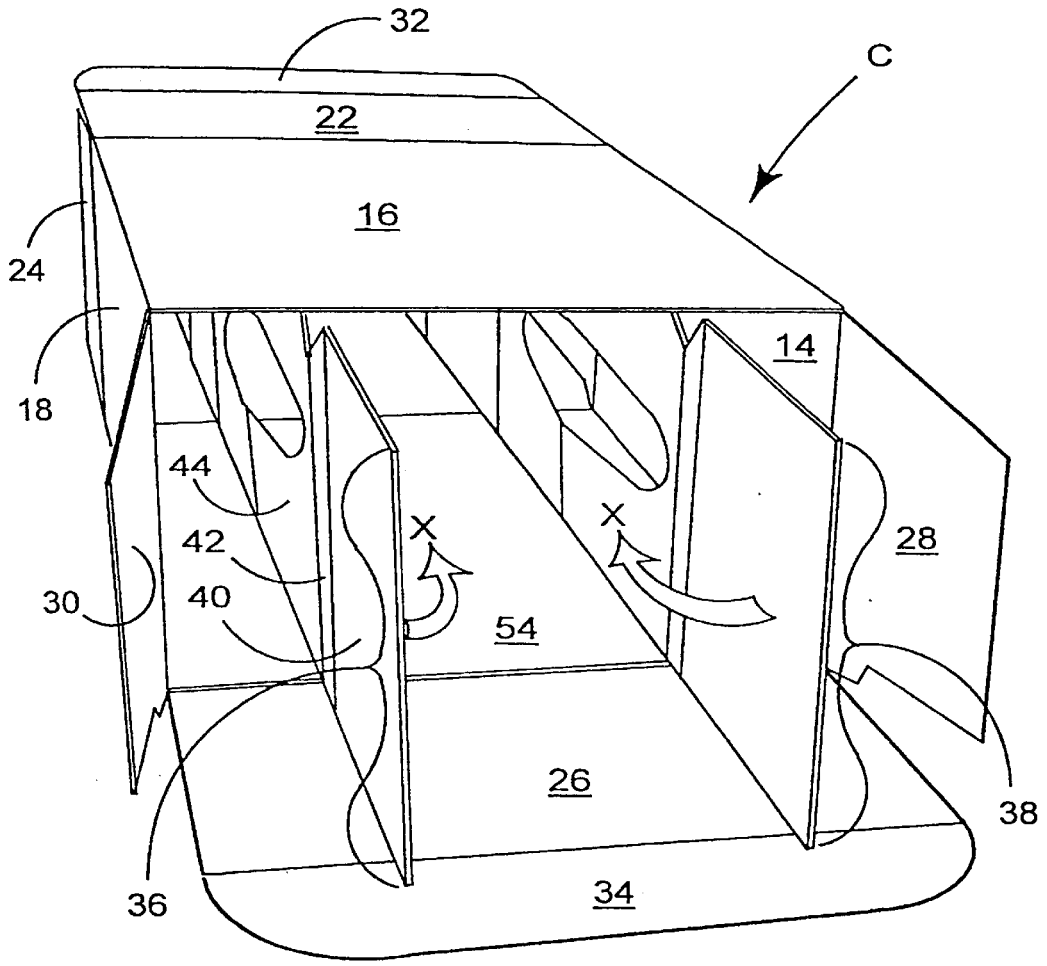
FIG. 2 is a perspective view from below of the blank of FIG. 1 when partially erected to form a carton.

Turning to FIG. 1A and FIG. 2, glue is preferably first applied to securing panels 52, 54. Of course, it is envisaged that other known securing means could be employed without departing from the scope of protection.

The securing panels, together with article receiving structures 36 and 38 are then, in this embodiment, folded along fold lines 88, 90, 92 and 94 such that the receiving structures 36, 38 are placed in mutually opposed substantially parallel relationship, and second and third securing panels 52 and 54 are similarly placed in mutually opposed parallel relationship with the faces to which glue G has been applied facing outwardly. Free edge 108 of third securing panel 54 is now adjacent fold line 88, first and third securing panels 62, 54 being co-planar with the glued faces effectively now facing in the same direction.

Outer sleeve panels 12, 14, 16 and 18 are folded out of mutual alignment so as to form an open ended tubular structure enclosing the partially erected inner sleeve 10*b*. First securing panel 62 secures the outer sleeve, and the panels of the inner sleeve are dimensioned such that second securing panel is brought into face contacting relationship with second side panel 16, and is secured thereto by glue G. Third side panel 54 is likewise brought into face contacting relationship with first side panel 12, and is secured thereto by glue G. The carton is now in the partially erected form as illustrated in FIG. 2.

An alternative form of carton construction can be employed whereby the inner sleeve 10*a* is folded towards outer sleeve 10*b* along fold line 70 and securing panel 52 is secured to side wall panel 16 by glue or other suitable means known in the art. Thereafter, article receiving structure 38 and third securing panel 54 are folded out of alignment with second securing panel 52 along fold line 92 and into face contacting relationship with second securing panel and first article receiving structure 36, whereby the end edge 108 abuts fold line 88 to provide a contiguous face. End wall panel 14 is folded along fold line 66 so as to be placed in overlapping arrangement with second receiving structure 38 and first side wall panel 12 is brought into face contacting arrangement with the outer surface of third securing panel 54 and first securing panel 62 to be secured therewith.

At this stage of construction, the carton remains collapsible, and may optionally be supplied to the customer in collapsed form, shown in FIG. 1A, for subsequent complete erection on the customer's premises, thereby minimising space required during transport, and hence reducing costs.

Figure 3:
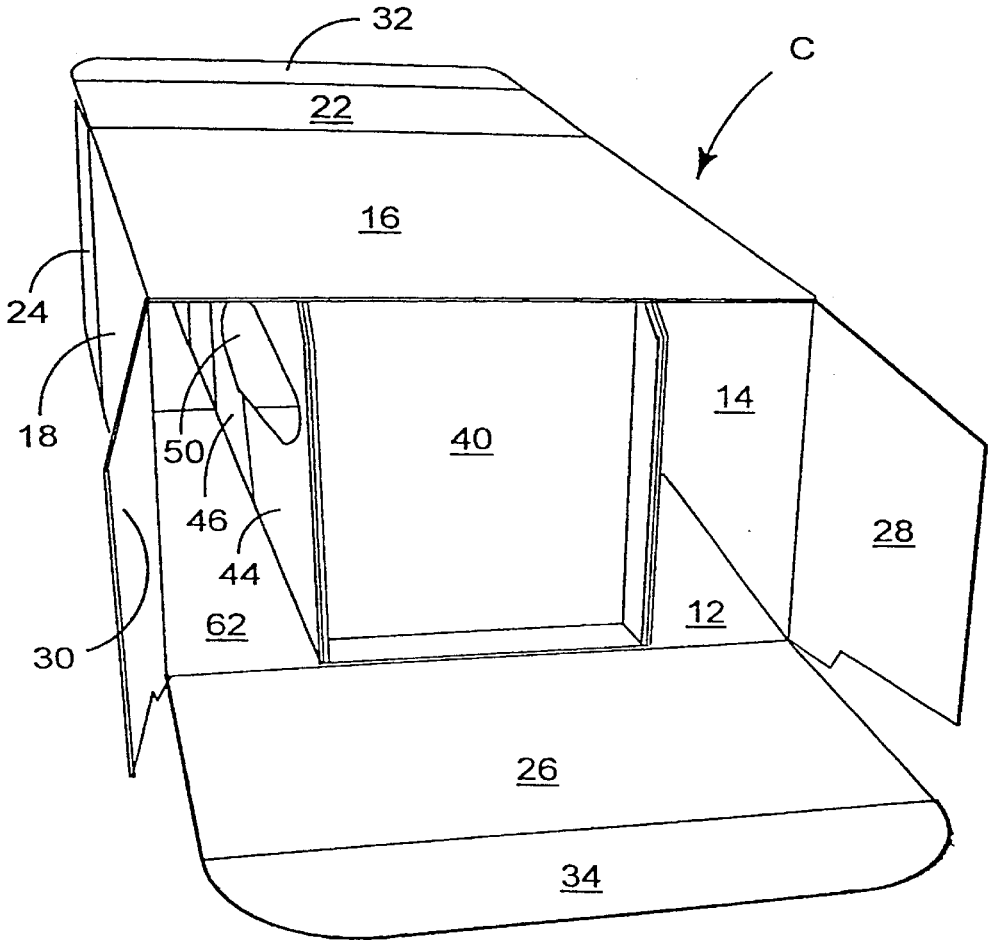
FIG. 3 is a perspective view of the blank at a later stage of the erection process than illustrated in FIG. 2.

In order to complete construction of the carton, by reference to FIG. 2 and FIG. 3, recess panel 42 is then folded inwardly along fold line 98 through substantially 180° as illustrated by arrow X so as to partially overlie main receiving panel 44. Central bridging panel 40 is folded through substantially 90° in the opposite direction relative to recess panel 42, so as to be positioned substantially perpendicular to main receiving panel 44, spanning the space between the corresponding main bridging panel of he opposed receiving structure 38. A similar operation is carried out with the corresponding panels of receiving structure 38 such that bridging panels 40 and 110 are in substantially face contacting relationship as is shown in FIG. 3. The bridging panels 40, 110 may optionally be secured together using glue or other suitable means known in the art.

The base of the carton C is closed by folding base end flaps 28, 30 and base wall panel 26 inwardly out of alignment with corresponding end and side wall panels 12, 16 and 18. Securing flap 34 may be sandwiched between second side panel 16 and the non-glued portion of second securing panel 52. The beveled portions 43, 45 of main receiving panel 44 and recessing panel 42 help to guide the flaps 34 between inner part and outer sleeves the location of the flap 34.

Figure 6:
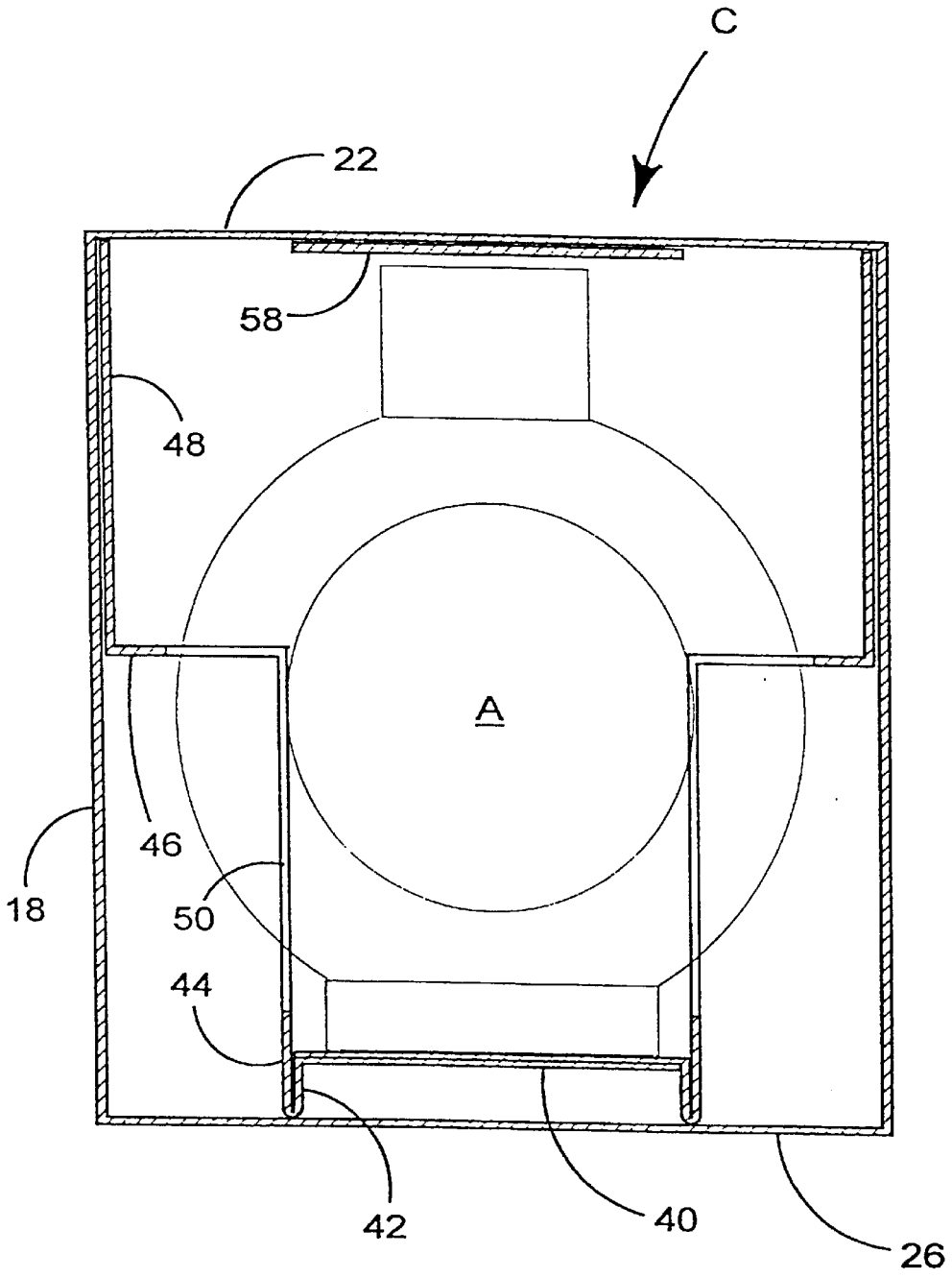
FIG. 6 is a cross-sectional view of the carton with an article in place viewed from the side thereof.

As can be seen perhaps most clearly from FIG. 6, the bridging panels 40, 110 impart rigidity to the carton whilst establishing an enclosed space between the bottom of Article A and the base of the carton.

Figure 4:
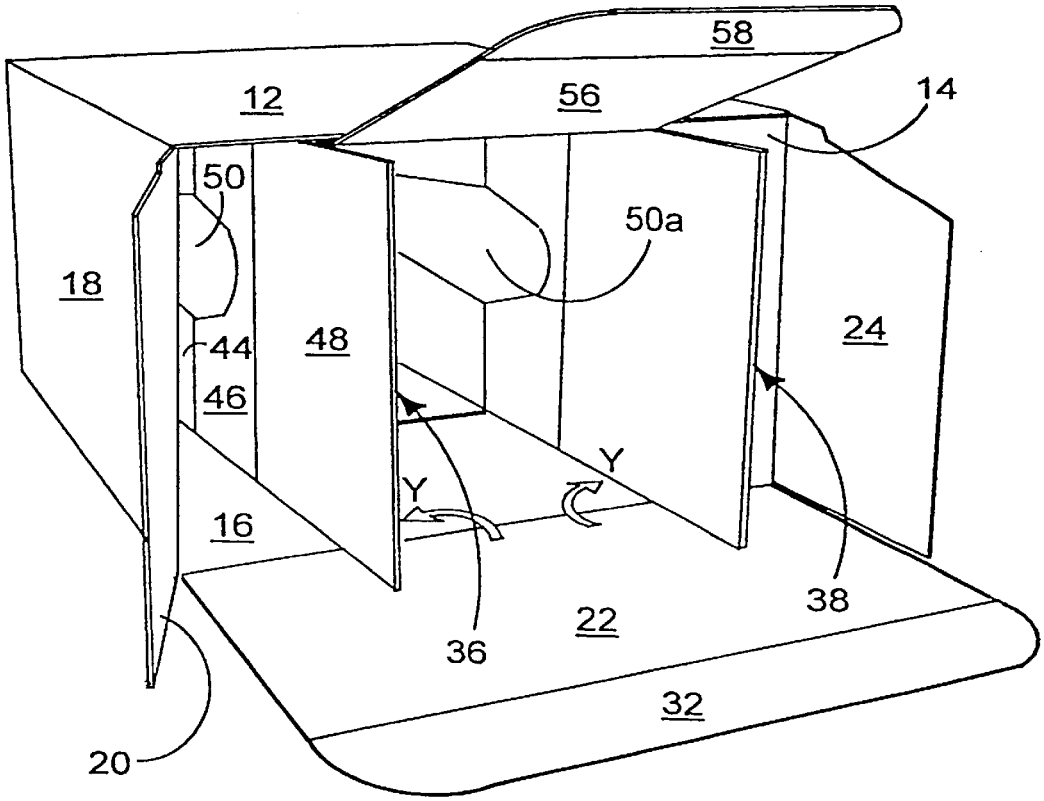
FIG. 4 is a perspective view from above of the blank of FIG. 1 when partially erected to form a carton.
Figure 5:
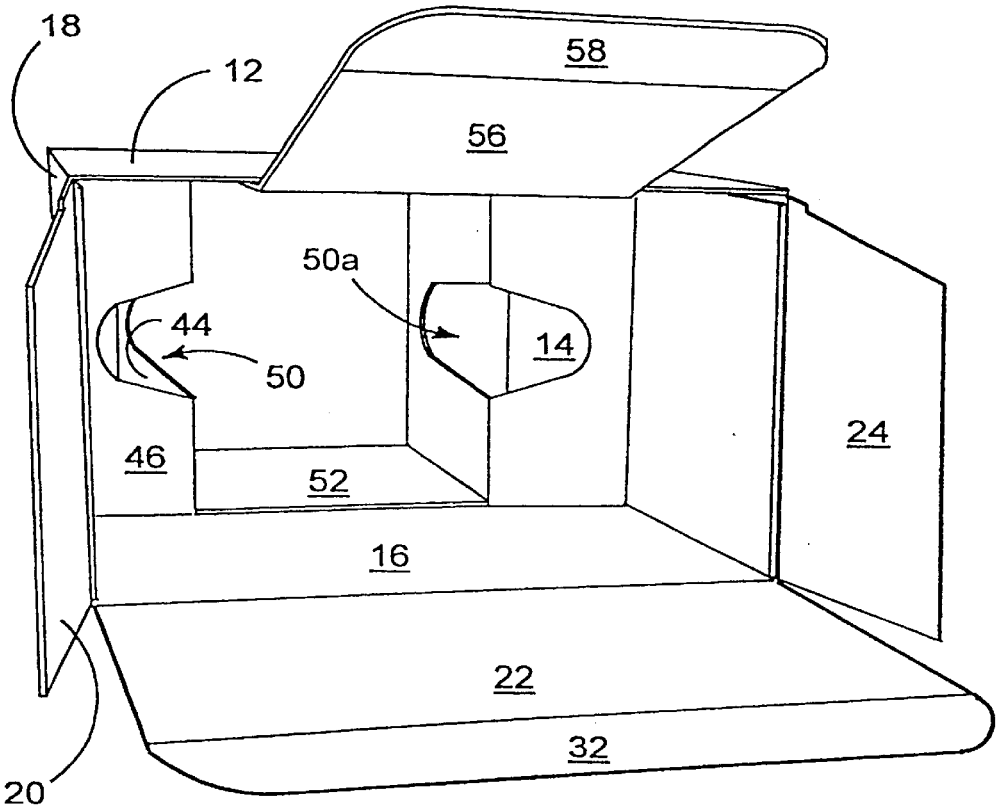
FIG. 5 is a perspective view from above of the carton ready to receive an article.

Turning now to the construction of the upper portion of the inner sleeve 10*a*, as illustrated in FIGS. 4 and 5, transverse receiving panel 46 is folded outwardly along fold line 100, whilst end wall contacting panel 48 is, preferably, simultaneously folded in the opposite direction, the combination of both operations being represented by arrow Y. Thus, panel 48 is placed in a face contacting relationship with end wall panel 18, and transverse panel 46 spans the gap between main receiving panel 44 and end wall panel 18. By spanning the gap, the panel 48 acts as a brace to provide additional support to panel 44, thereby reducing unwanted internal movement.

In the particularly preferred embodiment illustrated, transverse panel 46 is dimensioned such that when panel 48 is brought into face contacting relationship with panel 18, transverse panel 44 is substantially perpendicular to both main receiving panel 44, and end wall contacting panel 48. This allows both panels 46 and 48 to be mechanically maintained in their desired position without the need for additional securing means.

In alternative classes of embodiment however, transverse panel may be dimensioned differently such that an acute or obtuse angle would exist between main receiving panel 44 and transverse receiving panel 46. In these embodiments, it would be preferable for glue or other securing means known in the art to be provided between panel 48 and end wall panel 18, so as to maintain the article receiving structure 36 in its set up condition.

Article receiving structure 38 is also set up in a similar manner, as is illustrated in FIG. 5.

The article A is then loaded into the carton C, and is held by the apertures 50, 50*a* provided in the article receiving structures 36, 38. Inner cover panel 56 is then folded inwardly along fold line 104 so as to overlie the top of article A. Securing flap 58 is folded along fold line 106 so as to be brought into face contacting relationship with second side panel 16. The carton is then closed by folding top end flaps 20 and 24, and top wall panel 22 inwardly along their respective fold lines 86, 80, 82 in a similar manner to the base wall panel end flaps of the base wall structure, as described above. Securing flap 32 is preferably held between an unsecured portion of third securing panel 54, and first side panel 12. Beveled corner portions (not shown) similar to those described above could be included to guide securing flap 32 to the desired position.

FIG. 6 illustrates in cross sectional view the fully erected carton with article A loaded therein. It should be understood that the base and sides of the article A are spaced from the adjacent walls of the carton 12, 14, 16, 18, 26, but are held snugly such that substantially no movement of the article A within the carton is possible. It should be appreciated that the article receiving structures 36 and 38 provide one or more "crumple zone(s)" which may be deformed if there is an impact between the carton and another body, thus substantially absorbing the energy of such an impact without damaging the article A within. For example, the crumple zones may be provided by panels 42/44; 46 or 48. In order to adjust the deformation characteristics of the article receiving structures 36 and 38, the caliper of the paperboard or like materials may be changed and/or the dimension of the panels and apertures adjusted such that a greater or lesser distance between the article and the walls of the carton may be provided.

Referring now to FIGS. 7A and 7B, there is shown an alternative embodiment of the invention in which like parts have been annotated with like numerals but with the addition of the prefix "1". Therefore, only the differences will be described in any greater detail. FIG. 7A illustrates the inner sleeve 110*a* of a two part blank and FIG. 7B illustrates the outer sleeve 110*b* of a two part blank.

Inner sleeve 110*a* is erected in a similar manner to inner sleeve 10*a* of the first embodiment however, glue G is applied to the same face of first support panel 162 as it is to second support panel 152 and third support panel 154. As the inner sleeve 110*a* is folded along fold lines 188, 190, 192 and 194 so as to form a tubular structure in which article receiving structures 136 and 138 are placed in mutually opposing relationship, first securing panel 162 is folded such that its free edge is brought into contact with the cutaway portion of third securing panel 154 as is defined by free edge 108 thereof. The shape of the cut-away portion, and first support panel may be altered within the scope of the invention.

Outer sleeve 110*b* is erected in a similar manner to outer sleeve 10*b* of the first embodiment, the only difference being that an additional securing flap 119 is provided, being hingedly interconnected with second end panel 118 along fold 170. As the outer sleeve is folded so as to form a tubular structure, glue or other suitable means known in the art secures flap 119 to first side panel 112. The use of a two part blank, allows the inner sleeve to be made from a differing grade and/or caliper of paperboard or like material from the outer sleeve, and furthermore simplifies the application of glue to the inner sleeve, as glue needs to be applied to one face of the blank only.

Figure 8:
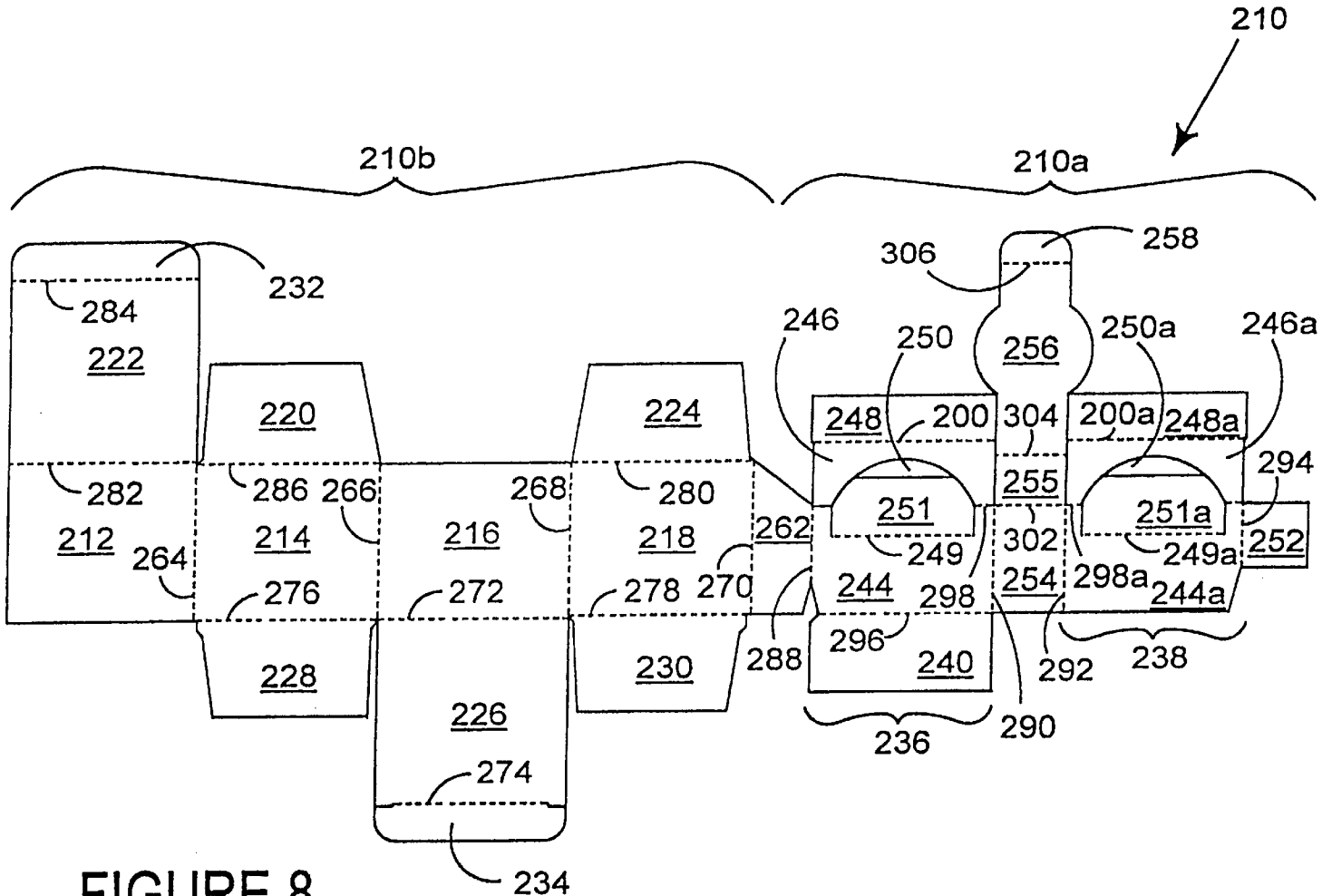
FIG. 8 is a plan view of a blank according to a third embodiment of the invention.

Referring to FIG. 8, there is shown another embodiment of the invention in which a carton is formed from a single blank 210 of paperboard or similar foldable sheet material adapted to accommodate an article such as a bottle, particularly a fragile article such as a bottle of perfume, for example. Again, it is envisaged that the blank could be two parts.

In this embodiment, the blank comprises two portions, outer sleeve 210*b*, and inner sleeve 210*a*. Turning first to outer sleeve 210*b*, the panels correspond substantially to the first embodiment and like references have been used with the prefix "2". Thus, there comprises a first side wall panel 212, first end wall panel 214, second side wall panel 216 and second end wall panel 218 are hingedly interconnected in series along fold lines 264, 266 and 268 respectively. A top wall and base wall structure are provided that in this embodiment correspond substantially to the first embodiment and are not therefore described in any greater detail. It should be recognised that in alternative classes of embodiment other known end closure structures may be employed.

Turning to inner sleeve portion 210*a*, there is provided a plurality of panels for forming an article support structure. In this embodiment, there is a first securing panel 262, first article receiving structure 236, first intermediate panel 254, second article receiving structure 238, and second intermediate panel 252, hingedly interconnected in series along fold lines 288, 290, 292 and 294 respectively. First securing panel 262 is further hingedly connected to second side panel 218 of the outer sleeve 210*a* along fold line 270.

Second article receiving structure 238 is, in this embodiment, substantially identical to the first article receiving structure except that in this embodiment structure 238 does not include an equivalent of bridging panel 240. Like panels are designated with the same numeral with the addition of the letter "a". Therefore, only the first article receiving structure 236 is described in greater detail. Structure 236 preferably comprises central bridging panel 240, article receiving panel 244, transverse receiving panel 246 and upper panel 248 hingedly interconnected in series along fold lines 296, 298 and 200 respectively.

In addition, an aperture 250 is provided in main receiving panels 244 for receiving the article A, once the blank has been erected to form a carton. Preferably, the aperture 250 extends into transverse receiving panel 246. Naturally, the size and shape of the aperture may be altered to receive differing articles.

There may further comprise a platform panel 251 formed from one of the panels forming the article retention structure. In this embodiment the platform panel 251 is struck from one or more of the main and transverse panels 244, 246. FIG. 8 illustrates panel 251 is hingedly connected to an edge of aperture 250. Optionally, platform panel 251 conforms to the shape of a portion of the article.

It is envisaged that a platform panel could be incorporated into the first or second embodiments.

An inner cover panel 256 may be provided that is hingedly connected to intermediate panel 254. Securing flap 258 is further advantageously hingedly connected to inner cover panel 256 along fold line 306. There may also comprise spacer panel 255 hingedly connected to intermediate panel 254 along fold line 302 and to inner cover panel 256 along opposing fold line 304.

Turning now to the construction of the carton illustrated in FIGS. 9, 9A, 10 and 10A. In some embodiments, glue is first applied to securing panel 262, to intermediate panels 252 and 254, and optionally to spacer panel 255.

The inner sleeve is formed in like manner described above, whereby the panels forming the receiving structures are folded out of alignment to be placed in mutually opposed substantially parallel relationship, and first and second intermediate panels 254 and 252 are similarly placed in mutually opposed parallel relationship with the faces to which glue G has been applied facing outwardly. Thereafter, the outer sleeve panels 212, 214, 216 and 218 are now preferably folded out of mutual alignment so as to form an open ended tubular structure enclosing the partially erected inner sleeve 210*b* and is secured to the inner sleeve in like manner described above.

Of course, the alternative approach can be used described above whereby the panels of the inner sleeve are folded into face contacting arrangement with the outer panels of the sleeve to provide a flap collapsed carton, similar to the embodiment of FIG. 1.

Like the first and second embodiments, the carton of this embodiment remains collapsible, and may optionally be supplied to the customer in collapsed form for subsequent complete erection on the customer's premises.

Figure 9:
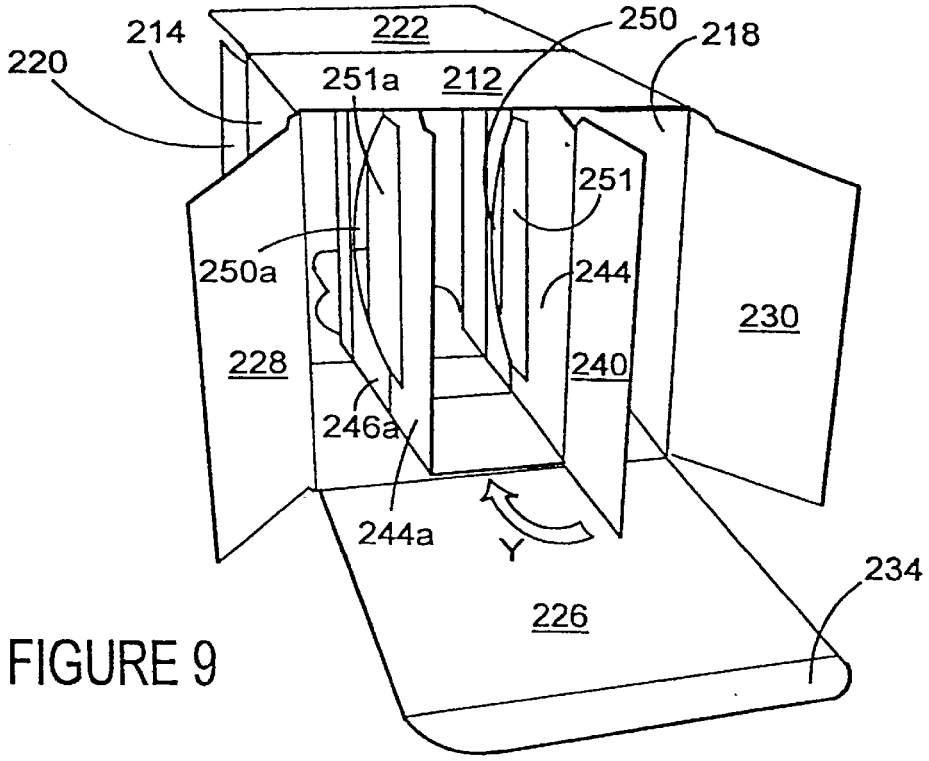
FIG. 9 is a perspective view from below of the blank of FIG. 8 when partially erected to form a carton.
Figure 9A:
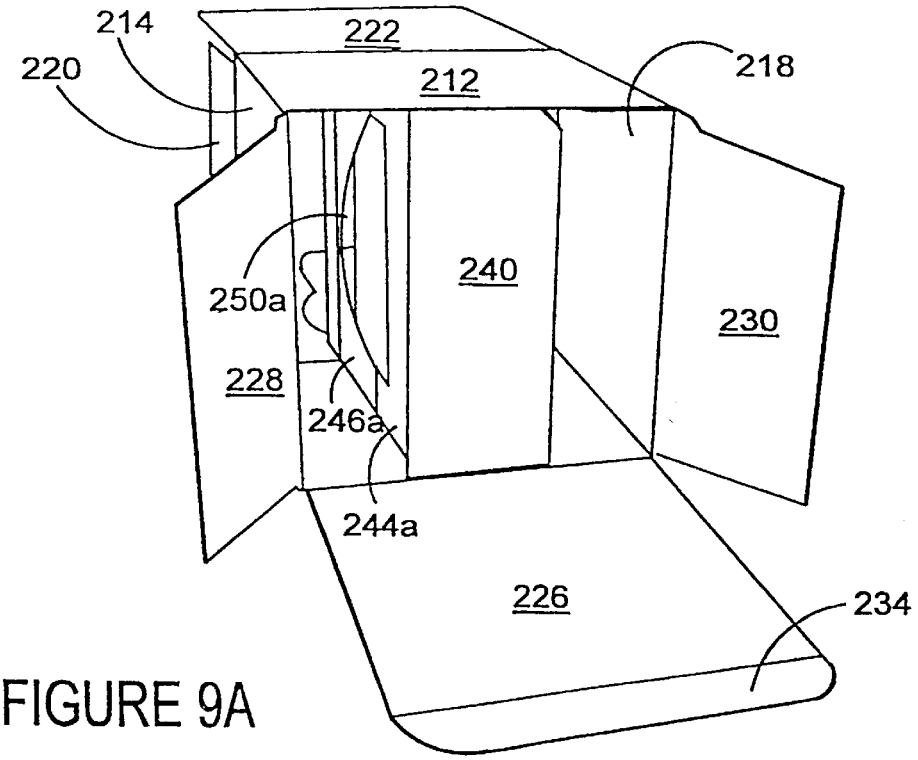
FIG. 9A is a perspective view of the blank at a later stage of the erection process than illustrated in FIG. 9.

The carton is then in a part-erected form shown in FIG. 9, the base structure is formed by folding central bridging panel 240 inwardly along fold line 296 through substantially 90° as illustrated by arrow Y so as to be positioned substantially perpendicular to main receiving panel 244, spanning the space between the opposed receiving structures 236, 238. The bridging panel 240 may optionally be secured to main receiving panel 244*a* using glue or other suitable means known in the art. In such embodiments, bridging panel 240 is advantageously provided with a securing flap that may be brought into contact with panel 244*a*. The base of the carton is illustrated in FIG. 9A.

The base of the carton is closed by folding base end flaps 228, 230 and base wall panel 226 inwardly out of alignment with corresponding end and side wall panels 214, 216 and 218 whereby panel 234 is sandwiched between first side panel 212 and a non-glued portion of second intermediate panel 252. Beveled portions of main receiving panel 244 and recessing panel 242 may be provided to guide the flap 234 into position.

Bridging panel 240 may advantageously be reduced in width so as not to engage first side panel 212, thereby assisting the function of the beveled portions. As can be seen perhaps most clearly from FIG. 9A, the bridging panel 240 imparts rigidity to the carton.

Figure 10:
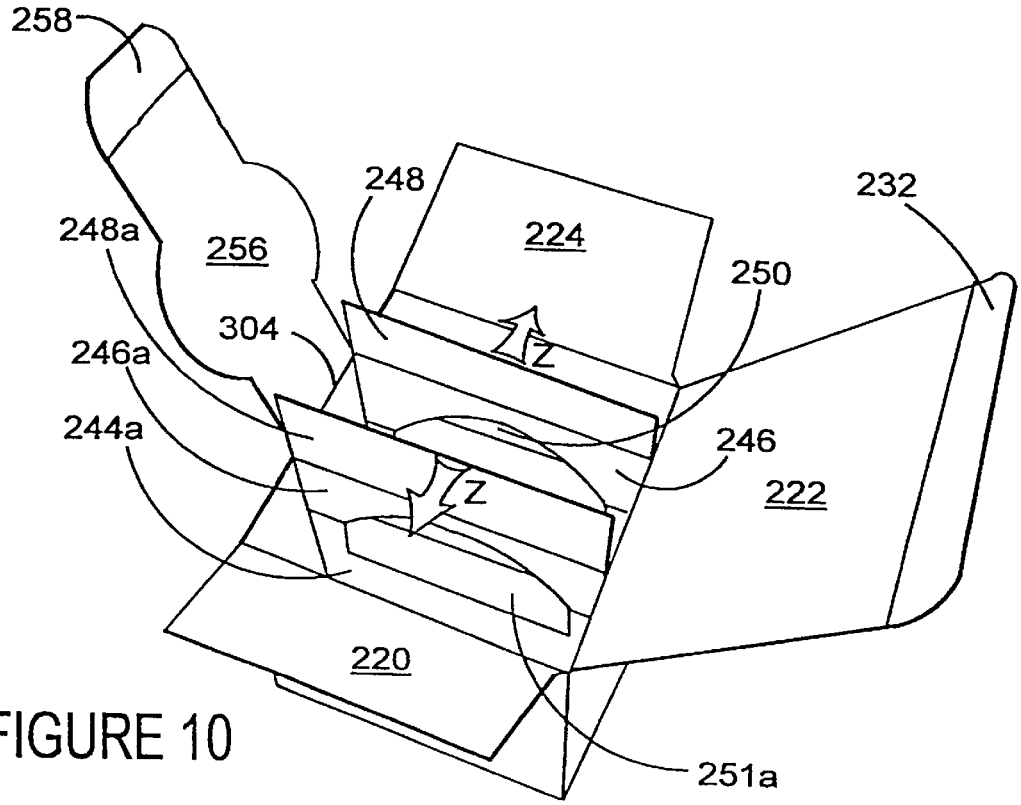
FIG. 10 is a perspective view from above of the blank of FIG. 8 when partially erected to form a carton.
Figure 10A:
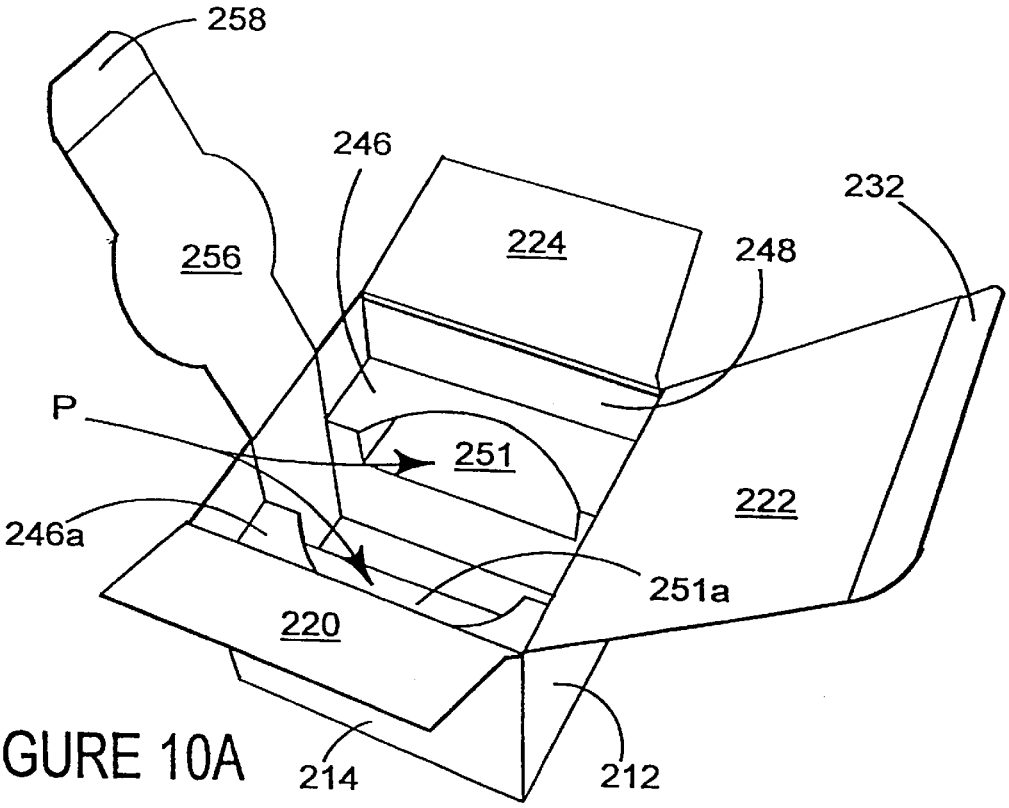
FIG. 10A is a perspective view from above of the carton ready to receive an article.

Turning to the construction of the upper portion of the inner sleeve 210*a*, as illustrated in FIGS. 10 and 10A, transverse receiving panel 46 is folded outwardly along fold line 298, whilst upper panel 248 is preferably simultaneously folded in the opposite direction, the combination of both operations being represented by arrow Z. Upper panel 248 is placed in a face contacting relationship with end wall panel 218, and transverse panel 246 spans the gap between main receiving panel 244 and end wall panel 218 to provide a brace, similar to the first embodiment.

In the particularly preferred embodiment illustrated, transverse panel 246 is dimensioned such that when panel 248 is brought into face contacting relationship with side panel 218, transverse panel 246 is substantially perpendicular to both main receiving panel 244, and end wall contacting panel 248. This allows both panels 246 and 248 to be mechanically maintained in their desired position without the need for additional securing means.

In alternative classes of embodiment however, transverse panel may be dimensioned differently such that an acute or obtuse angle would exist between main receiving panel 244 and transverse receiving panel 246. In these embodiments, it would be preferable for glue or other securing means known in the art to be provided between upper panel 248 and end wall panel 218, so as to maintain the article receiving structure 236 in its set up condition.

Article receiving structure 238 is also set up in a similar manner, as is illustrated in FIG. 10A.

The article A (FIG. 11) is loaded into the carton, and is held by the apertures 250, 250*a* provided in the article receiving structures. Platform panels 251 and 251*a* are folded along fold lines 249 and 249*a* respectively into a substantially horizontal plane to define a platform P upon which the article A rests, shown in FIG. 11. In some embodiments, the panels 252 and 251*a* abut the adjacent side wall to be engaged therewith by suitable means. The platform P provides additional rigidity to prevent unwanted movement of the side walls and main receiving panels, and also substantially prevents the unprinted inner faces of the base, end and side wall panels being visible to the end user of the carton, when viewed from above.

Figure 11:
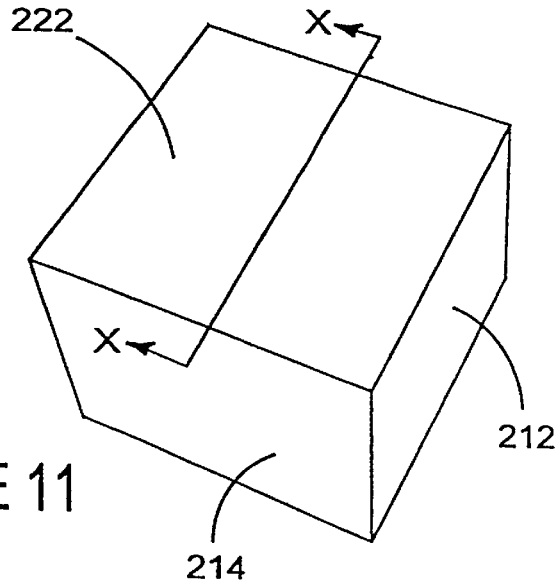
FIG. 11 is a perspective view from above the carton in a loaded and set up condition.

To complete construction of the carton, inner cover panel 256 is then preferably folded inwardly along fold line 204 so as to overlie the top of article A. Flap 258 is folded along fold line 206 so as to be brought into face contacting relationship with first side panel 216. The carton is then closed by folding top end flaps 220 and 224, and top wall panel 222 inwardly along their respective fold lines 286, 280, 282 in a similar manner to the base wall panel end flaps of the base wall structure, as described above. Tab 232 is preferably held between an unglued portion of spacer panel 255 or first intermediate panel 254, and first side panel 212 to complete the carton as shown in FIG. 11.

Figure 11A:
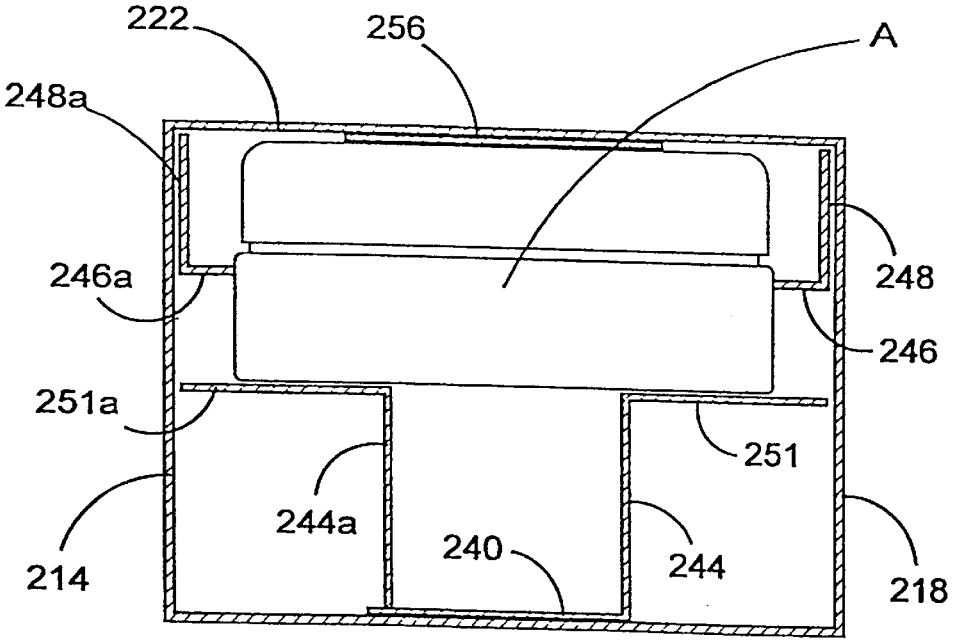
FIG. 11A is a cross-sectional view through X-Y of the carton shown in FIG. 11.

FIG. 11A illustrates in cross sectional view the fully erected carton with article A loaded therein. It should be understood that the base and sides of the article A are spaced from the adjacent walls of the carton 212, 214, 216, 218, 226, but are held snugly such that substantially no movement of the article A within the carton is possible. It should be appreciated that the article receiving structures 236 and 238 provide a "crumple zone" which may be deformed if there is an impact between the carton and another body, thus substantially absorbing the energy of such an impact without damaging the article A within. In order to adjust the deformation characteristics of the article receiving structures 236 and 238, the caliper of the paperboard or like materials may be changed and/or the dimension of the panels and apertures adjusted such that a greater or lesser distance between the article and the walls of the carton may be provided.

It will be recognised that as used herein, directional references such as "top", "base", "end", and "side", "inner", "outer", "upper" and "lower" do not limit the respective panels to such orientation, but merely serve to distinguish these panels from one another. Any reference to hinged connection should not be construed as necessarily referring to a single fold line only: indeed it is envisaged that hinged connection can be formed from one or more of one of the following, a score line, a frangible line or a fold line, without departing from the scope of invention.

It should be understood that various changes may be made within the scope of the present invention, for example, the size and shape of the panels and apertures may be adjusted to accommodate articles of differing size or shape, alternative top and base closure structures may be used. A single article receiving structure may be provided in some embodiments, and in other embodiments a linear array of additional apertures may be provided in each of the article receiving structures such that the carton may accommodate more than one article. Additional panel(s) may be provided between the main and transverse article receiving panels so as to form a curved interface therebetween.

What is claimed is:

1. A carton comprising an outer sleeve and an inner article receiving structure, wherein the inner article receiving structure comprises an inner sleeve having a first pair of opposed side walls secured to a first pair of opposed side walls of the outer sleeve and a second pair of opposed side walls spaced apart from a second pair of opposed side walls of the outer sleeve, and the inner structure further comprises a first bridging closure panel hingedly connected to one end of the inner sleeve for movement between an open position where the bridging closure panel allows the inner and outer sleeves to collapse into a flat form and a closed position where the bridging closure panel forms a first brace structure between one of the second pair side walls of the inner structure and an adjacent one of the second pair side walls of the outer sleeve and provides resistance to collapse of the inner and outer sleeves.

2. The carton according to claim 1 wherein the bridging closure panel is hingedly connected to the one second pair side wall of the inner structure, the bridging closure panel being disposed in the plane of the one second pair side wall of the inner structure when in the open position.

3. The carton according to claim 2 wherein the bridging closure panel comprises a bridge panel hingedly connected to the one second pair side wall of the inner structure, and a recess panel hingedly connected to the bridge panel, the recess panel overlies the adjacent one second pair side wall of the outer sleeve when the bridging closure panel is in the closed position, and the bridge panel extends from the recess panel to the one second pair side wall of the inner structure when the bridging closure panel is in the closed position.

4. The carton according to claim 1 wherein the inner structure further comprises a second bridging closure panel hingedly connected to the other second pair side wall of the inner structure for movement between an open position where the second bridging closure panel allows the inner and outer sleeves to collapse into a flat form and a closed position where the second bridging closure panel forms a second brace structure between the other second pair side wall of the inner structure and the other second pair side wall of the outer sleeve and provides resistance to collapse of the inner and outer sleeves.

5. The carton according to claim 1 wherein the outer sleeve includes an end closure structure, wherein the inner structure comprises a beveled portion formed in the inner sleeve such that a securing flap of the end closure structure may be guided into a gap between one of the first pair side walls of the inner structure and adjacent one of the first pair side walls of the outer sleeve.

6. The carton as claimed in claim 2 wherein the inner sleeve defines an inner sleeve axis, outer sleeve defines an outer sleeve axis extending parallel to the inner sleeve axis, the bridging closure panel is connected to the one second pair side wall of the inner structure along a first fold line which is generally perpendicular to the inner and outer sleeve axes.

7. The carton according to claim 2 wherein the one second pair side wall of the inner structure has an aperture for receiving and supporting a portion of an article.

8. The carton according to claim 7 wherein the aperture of the one second pair side wall extends into the bridging closure panel.

9. The carton according to claim 4 wherein the second pair side walls of the inner structure have apertures for receiving and supporting portions of an article, respectively.

10. The carton according to claim 9 wherein the apertures of the second pair side walls extend respectively into the first and second bridging closure panels.

* * * * *